US012808153B2

(12) United States Patent
Noda et al.

(10) Patent No.: US 12,808,153 B2
(45) Date of Patent: Nov. 24, 2026

(54) STOP INSTRUCTION SYSTEM

(71) Applicant: KOBELCO CONSTRUCTION MACHINERY CO., LTD., Hiroshima (JP)

(72) Inventors: Daisuke Noda, Hiroshima (JP); Koji Yamashita, Hiroshima (JP); Takayuki Doi, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 385 days.

(21) Appl. No.: 18/245,728

(22) PCT Filed: Aug. 30, 2021

(86) PCT No.: PCT/JP2021/031753

§ 371 (c)(1),
(2) Date: Mar. 17, 2023

(87) PCT Pub. No.: WO2022/064968

PCT Pub. Date: Mar. 31, 2022

(65) Prior Publication Data

US 2024/0026643 A1 Jan. 25, 2024

(30) Foreign Application Priority Data

Sep. 25, 2020 (JP) ..... 2020-161094

(51) Int. Cl.

| | |
|---|---|
| ***E02F 9/20*** | (2006.01) |
| ***E02F 3/43*** | (2006.01) |
| ***E02F 9/26*** | (2006.01) |

(52) U.S. Cl.

CPC ..... *E02F 9/2033* (2013.01); *E02F 3/439* (2013.01); *E02F 9/262* (2013.01)

(58) Field of Classification Search

None

See application file for complete search history.

(56) References Cited

U.S. PATENT DOCUMENTS

2005/0000703 A1 1/2005 Furuno et al.
2017/0130405 A1* 5/2017 Engelmann ..... E01C 23/127

(Continued)

FOREIGN PATENT DOCUMENTS

EP 1 445 386 A1 8/2004
EP 3 399 109 A1 11/2018

(Continued)

OTHER PUBLICATIONS

Extended European Search Report issued Jan. 3, 2024 in European Patent Application No. 21872100.9, 6 pages.

(Continued)

*Primary Examiner* — Adam D Tissot
*Assistant Examiner* — Laura E Linhardt
(74) *Attorney, Agent, or Firm* — Oblon, McClelland, Maier & Neustadt, L.L.P.

(57) ABSTRACT

A distance detection unit detects a first distance from a specific reference position associated with a work machine to a portion of a platform of a carrier on a carrier rear side, and a second distance from the reference position to a portion of the platform on a carrier front side. A controller causes a stop instruction output unit to output a stop instruction at least either when the first distance falls from a value greater than a first threshold value to a value equal to or smaller than the first threshold value or when the second distance falls from a value greater than a second threshold value to a value equal to or smaller than the second threshold value.

13 Claims, 6 Drawing Sheets

(56) References Cited

U.S. PATENT DOCUMENTS

| | | | | |
|---|---|---|---|---|
| 2018/0305902 | A1 | 10/2018 | Tsukamoto | |
| 2018/0328003 | A1* | 11/2018 | Tsukamoto | E02F 9/2242 |
| 2019/0367030 | A1 | 12/2019 | Tanaka et al. | |
| 2020/0399865 | A1 | 12/2020 | Tsukamoto | |
| 2021/0165414 | A1 | 6/2021 | Aizawa et al. | |
| 2021/0237827 | A1* | 8/2021 | Tomura | B62J 50/22 |
| 2021/0262195 | A1* | 8/2021 | Nishi | E02F 9/265 |
| 2021/0284238 | A1* | 9/2021 | Raeis Hosseiny | B60D 1/62 |
| 2021/0310213 | A1* | 10/2021 | Aizawa | E02F 9/2029 |
| 2021/0363726 | A1 | 11/2021 | Aizawa et al. | |

FOREIGN PATENT DOCUMENTS

| | | | |
|---|---|---|---|
| JP | 10-88628 | A | 4/1998 |
| JP | 2016-89389 | A | 5/2016 |
| JP | 2020-20156 | A | 2/2020 |
| JP | 2020-60032 | A | 4/2020 |

OTHER PUBLICATIONS

International Search Report issued Nov. 16, 2021 in PCT/JP2021/031753 filed on Aug. 30, 2021 in 2 pages.

* cited by examiner

STOP INSTRUCTION SYSTEM

TECHNICAL FIELD

The present invention relates to a stop instruction system that issues an instruction to stop a carrier approaching a work machine.

BACKGROUND ART

For example, Patent Literature 1 and the like disclose a technique of stopping a carrier at a target stop position. In the technique disclosed in Patent Literature 1, when a position of a reference point of the carrier reaches the target stop position, a driving vehicle is stopped (see paragraph 0054, FIG. 1, and the like of Patent Literature 1).

It is important to stop the carrier at an appropriate position with respect to the work machine. It is therefore desired to issue an instruction to stop the carrier at an appropriate position.

CITATION LIST

Patent Literature

Patent Literature 1: JP 2020-60032 A

SUMMARY OF INVENTION

An object of the present invention is to provide a stop instruction system capable of issuing a stop instruction to stop a carrier at a timing when a position of the carrier relative to a work machine becomes appropriate.

The stop instruction system issues an instruction to stop the carrier approaching the work machine. The stop instruction system includes a distance detection unit, a stop instruction output unit, and a controller. The distance detection unit detects a distance of the carrier from the work machine. The stop instruction output unit outputs a stop instruction as the instruction to stop the carrier. The distance detection unit detects a first distance and a second distance. The first distance is a distance from a specific reference position associated with the work machine to a portion of a platform of the carrier on a carrier rear side. The second distance is a distance from the reference position to a portion of the platform on a carrier front side. A first threshold value as a threshold value related to the first distance and a second threshold value as a threshold value related to the second distance are set in the controller. The controller causes the stop instruction output unit to output a stop instruction at least either when the first distance falls from a value greater than a first threshold value to a value equal to or smaller than the first threshold value or when the second distance falls from a value greater than a second threshold value to a value equal to or smaller than the second threshold value.

DESCRIPTION OF EMBODIMENTS

Figure 1:
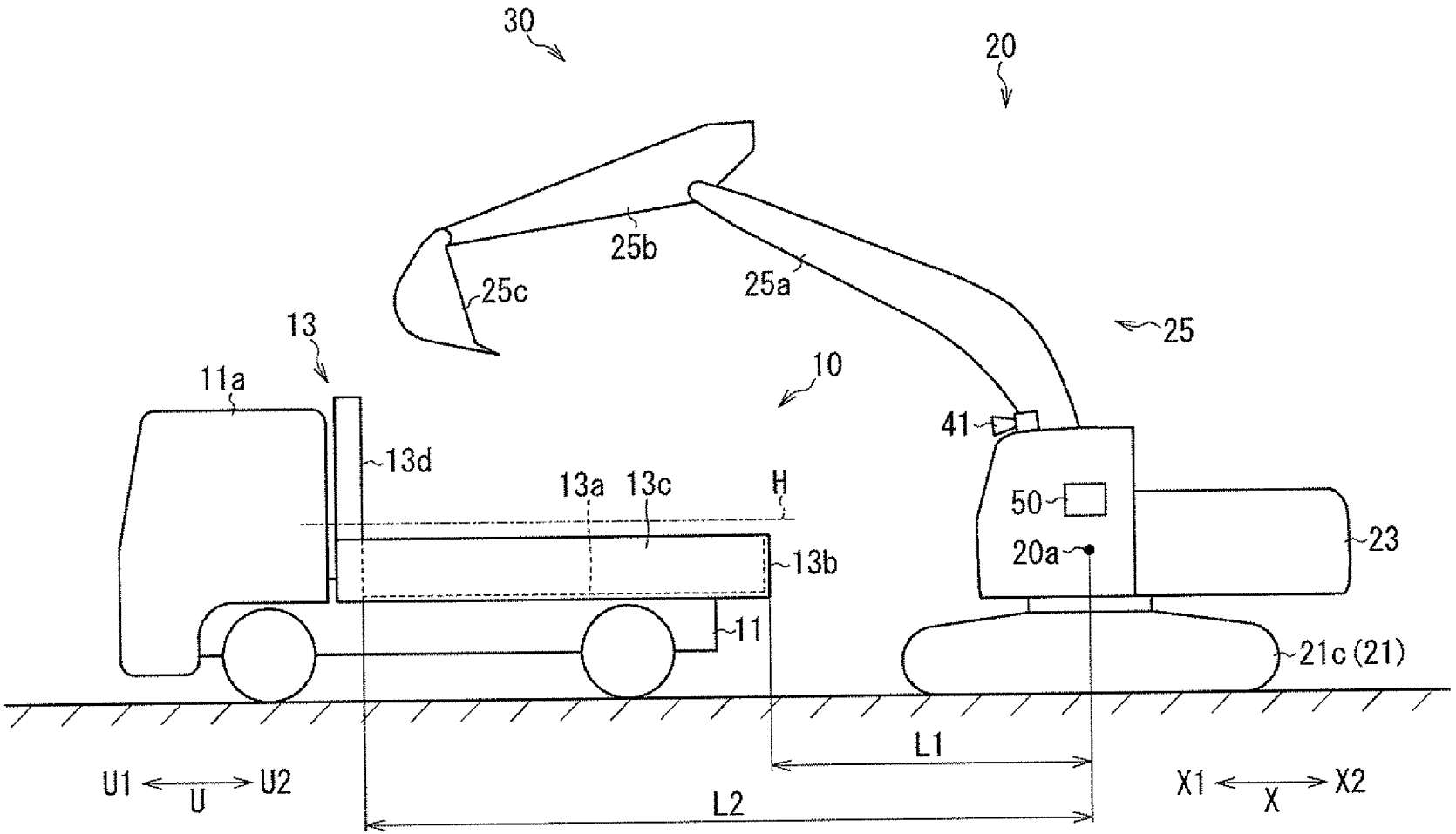
FIG. 1 is a diagram of a stop instruction system 30 and the like, and is a diagram of a carrier 10 and a work machine 20 as viewed from a side.

A carrier 10, a work machine 20, and a stop instruction system 30 shown in FIG. 1 will be described with reference to FIGS. 1 to 6.

The carrier 10 is a vehicle including a platform 13. The carrier 10 is a vehicle that transports a conveyance object loaded by the work machine 20. The carrier 10 may be a dump car or a truck. The carrier 10 includes a carrier body 11 and the platform 13. The carrier body 11 can travel and supports the platform 13. The carrier body 11 includes a carrier cab 11*a*.

The platform 13 accommodates a conveyance object. The conveyance object accommodated in the platform 13 may be, for example, earth and sand, stones, a waste, or the like. A carrier front rear direction U shown in FIG. 1 is a front rear direction of the carrier 10. A side facing from the platform 13 toward the carrier cab 11*a* is defined as a carrier front side U1 in the carrier front rear direction U, and a side facing from the carrier cab 11*a* toward the platform 13 is defined as a carrier rear side U2 in the carrier front rear direction U. The platform 13 may be movable with respect to the carrier body 11 or may be fixed to the carrier body 11. The platform 13 includes a platform floor 13*a*, a platform rear portion 13*b*, and a platform front portion 13*d*.

The platform floor 13*a* is a portion constituting a bottom of the platform 13. The platform rear portion 13*b* is a portion (for example, an end) of the platform 13 on the carrier rear side U2. The platform rear portion 13*b* protrudes upward from a portion of the platform floor 13*a* on the carrier rear side U2 and has, for example, a plate shape (gate board). The platform rear portion 13*b* has a flat surface or a substantially flat surface extending in a direction orthogonal or substantially orthogonal to the carrier front rear direction U. The platform front portion 13*d* is a portion of the platform 13 on the carrier front side U1. The platform front portion 13*d* protrudes upward from a portion of the platform floor 13*a* on the carrier front side U1 and has, for example, a plate shape (gateway). The platform front portion 13*d* protrudes higher than the platform rear portion 13*b*. The platform front portion 13*d* has a flat surface or a substantially flat surface extending in a direction orthogonal or substantially orthogonal to the carrier front rear direction U.

The work machine 20 is a machine that performs work, for example, a construction machine that performs construction work, for example, an excavator. The work machine 20 captures a conveyance object (for example, excavating earth and sand) and loads the captured conveyance object onto the carrier 10 (for example, removes soil). The work machine 20 includes a lower travelling body 21, an upper slewing body 23, and an attachment 25.

The lower travelling body 21 causes the work machine 20 to travel. The lower travelling body 21 includes, for example, left and right crawlers 21*c* and 21*c* (see FIG. 5). The upper slewing body 23 is mounted on the lower travelling body 21 so as to be able to slew.

The attachment 25 is mounted on the upper slewing body 23 so as to be raised and lowered. The attachment 25 includes a boom 25*a*, an arm 25*b*, and a distal end attachment 25*c*. The boom 25*a* is mounted on the upper slewing body 23 so as to be raised and lowered (rotatable up and down). The arm 25*b* is rotatably attached to the boom 25*a* (so as to be pushed and pulled). The distal end attachment 25*c* is provided at a distal end of the attachment 25 and is rotatably attached to the arm 25*b*. The distal end attachment 25*c* may be a bucket that scoops a conveyance object (for example, earth and sand) or a device (for example, a grapple) that pinches and holds the conveyance object.

(Direction Related to Work Machine 20 and the Like)

A direction in which a rotation axis of slewing of the upper slewing body 23 with respect to the lower travelling body 21 extends is defined as an up down direction of the work machine 20.

A work machine front rear direction X shown in FIG. 1 is a front rear direction of the work machine 20. A side toward which the attachment 25 protrudes from the upper slewing body 23 is defined as a work machine front side X1 in the work machine front rear direction X, the work machine front side X1 being a direction orthogonal to the up down direction of the work machine 20, and the opposite side is defined as a work machine rear side X2 in the work machine front rear direction X.

Figure 2:
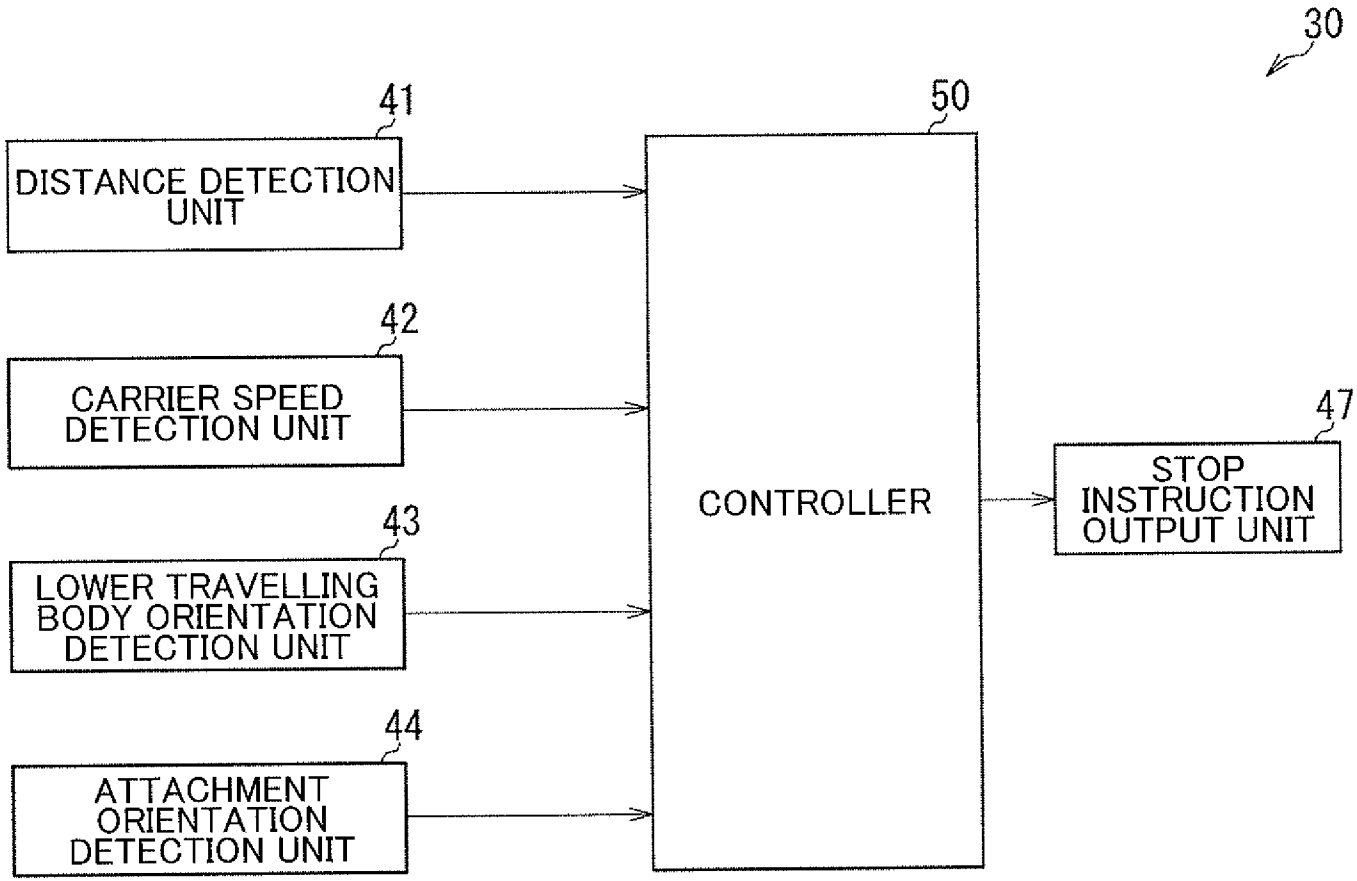
FIG. 2 is a block diagram of the stop instruction system 30 shown in FIG. 1.

The stop instruction system 30 is a system (for example, an automatic horn sounding system) that automatically issues a stop instruction to stop the carrier 10 approaching the work machine 20. As shown in FIG. 2, the stop instruction system 30 includes a distance detection unit 41, a carrier speed detection unit 42, a lower travelling body orientation detection unit 43, an attachment orientation detection unit 44, a stop instruction output unit 47, and a controller 50.

The distance detection unit 41 detects a distance of the carrier 10 from the work machine 20 shown in FIG. 1. The distance detection unit 41 detects a first distance L1 and a second distance L2. The first distance L1 is a distance (for example, the shortest distance) from a specific reference position 20*a* associated with the work machine 20 to the platform rear portion 13*b* of the carrier 10. The reference position 20*a* is, for example, a position uniquely determined from the position of the upper slewing body 23, and may be, for example, a proximal end of the boom 25*a* (an end close to the upper slewing body 23), or may be a specific point on a central axis of slewing of the upper slewing body 23 with respect to the lower travelling body 21. The second distance L2 is a distance (for example, the shortest distance) from the reference position 20*a* to the platform front portion 13*d*.

The distance detection unit 41 (position detection unit) may be able to detect the position of the carrier 10 relative to the work machine 20. Specifically, the distance detection unit 41 may detect three-dimensional position information of the carrier 10 and detect three-dimensional shape information of the carrier 10. In this case, the distance detection unit 41 acquires an image (distance image) having distance information (depth information). The distance detection unit 41 may detect the position of the carrier 10 based on three-dimensional information and two-dimensional information (image).

The distance detection unit 41 may detect the position (three-dimensional position information) of only a part of the carrier 10, and for example, may detect the position of only the platform 13 of the carrier 10. Only one distance detection unit 41 may be provided, or a plurality of distance detection units 41 may be provided. The distance detection unit 41 may be mounted on the work machine 20 or may be disposed outside the work machine 20 (for example, at a work site). When the distance detection unit 41 is disposed outside the work machine 20, it may be possible to detect a position that cannot be detected (for example, a portion hidden by the attachment 25) if the distance detection unit 41 is mounted only on the work machine 20. When the distance detection unit 41 is disposed outside the work machine 20, the stop instruction system 30 according to the present embodiment can be applied even if the work machine 20 does not include the distance detection unit 41.

The distance detection unit 41 is a sensor capable of detecting a distance in a non-contact manner. The distance detection unit 41 may include a device that detects three-dimensional information with laser light, and may include, for example, a light detection and ranging or laser imaging detection and ranging (LiDAR) or a time of flight (TOF) sensor. The distance detection unit 41 may include a device (for example, a millimeter-wave radar) that detects three-dimensional information with radio waves. The distance detection unit 41 may include a stereo camera. In a case where the distance detection unit 41 detects the three-dimensional position and shape of the carrier 10 based on the three-dimensional information and the two-dimensional information, the distance detection unit 41 may include a camera capable of detecting a two-dimensional image.

The carrier speed detection unit 42 (see FIG. 2) detects a speed of the carrier 10. The carrier speed detection unit 42 may be mounted on the work machine 20 or may be disposed outside the work machine 20. The carrier speed detection unit 42 may be shared or need not be shared with the distance detection unit 41 (the same applies to the lower travelling body orientation detection unit 43 and the attachment orientation detection unit 44 shown in FIG. 2). For example, the carrier speed detection unit 42 may detect (calculate) the speed of the carrier 10 from a change in the distance per unit time from the work machine 20 to the carrier 10 shown in FIG. 1. For example, the carrier speed detection unit 42 (see FIG. 2) may calculate the speed of the carrier 10 based on three-dimensional position information of the carrier 10. For example, the carrier speed detection unit 42 may be a speed sensor provided in the carrier 10.

The lower travelling body orientation detection unit 43 (see FIG. 2) detects an orientation (for example, an angle) of the lower travelling body 21 with respect to the carrier 10. The lower travelling body orientation detection unit 43 may be mounted on the work machine 20 or may be disposed outside the work machine 20. For example, the lower travelling body orientation detection unit 43 (see FIG. 2) may calculate an orientation of the lower travelling body 21 with respect to the carrier 10 based on an orientation of the carrier 10 with respect to the upper slewing body 23 and an orientation (slewing angle) of the upper slewing body 23 with respect to the lower travelling body 21. For example, the lower travelling body orientation detection unit 43 (see FIG. 2) may detect the orientation of the lower travelling body 21 with respect to the carrier 10 based on distance images (three-dimensional position and shape information) of the carrier 10 and the lower travelling body 21.

The attachment orientation detection unit 44 (see FIG. 2) detects an orientation of the attachment 25. The attachment orientation detection unit 44 may be mounted on the work machine 20 or may be disposed outside the work machine 20. For example, the attachment orientation detection unit 44 (see FIG. 2) may be one or a plurality of angle sensors mounted on the work machine 20. In this case, the attachment orientation detection unit 44 (see FIG. 2) detects an angle of the boom 25*a* with respect to the upper slewing body 23, an angle of the arm 25*b* with respect to the boom 25*a*, and an angle of the distal end attachment 25*c* with respect to the arm 25*b*. For example, the attachment orientation detection unit 44 (see FIG. 2) may detect the orientation of the attachment 25 based on a distance image of the attachment 25.

The stop instruction output unit 47 (see FIG. 2) outputs a stop instruction. The stop instruction output unit 47 may be mounted on the work machine 20 or may be disposed outside the work machine 20. The "stop instruction" may be an instruction perceptible by the driver in the carrier cab 11*a* of the carrier 10. In this case, the "stop instruction" may be, for example, an instruction of at least one of sound, light, or vibration. The "stop instruction" may be an electric signal for automatically stopping the carrier 10. The stop instruction output unit 47 may be a horn (for example, a horn mounted on the work machine 20), a speaker, a light, or a display (such as a monitor).

The controller 50 is a computer that inputs and outputs signals, performs arithmetic such as determination and calculation, stores information, and the like. The controller 50 may be mounted on the work machine 20 or may be disposed outside the work machine 20. A threshold value T (first threshold value T1 and second threshold value T2 (see FIG. 3)) is set in the controller 50. Hereinafter, the first threshold value T1 and the second threshold value T2 will be described mainly with reference to FIG. 3.

The first threshold value T1 is a threshold value related to the first distance L1 shown in FIG. 1. The first threshold value T1 is set so that a predetermined space is provided between the platform rear portion 13*b* and the work machine 20 when the first distance L1 is equal to the first threshold value T1. The "predetermined space" is a space at which the platform rear portion 13*b* and the work machine 20 do not come into contact with each other.

The second threshold value T2 is a threshold value related to the second distance L2. The second threshold value T2 is set so that the attachment 25 can reach the platform front portion 13*d* when the second distance L2 is equal to the second threshold value T2. The "can reach" may refer to a state in which the attachment 25 can come into contact with the platform front portion 13*d*. The above "can reach" refer to a state in which the attachment 25 can substantially come into contact with the platform front portion 13*d*, or may refer to a state in which the attachment 25 can be brought close to the platform front portion 13*d* to such an extent that a slight space is formed between the attachment 25 and the platform front portion 13*d*.

(Operation)

The outline of the operation of the stop instruction system 30 and the like is as follows. When at least either a condition α or β described below is satisfied, the controller 50 causes the stop instruction output unit 47 (see FIG. 2) to output a stop instruction. The condition α is that the first distance L1 falls from a value greater than the first threshold value T1 to a value equal to or smaller than the first threshold value T1. The condition β is that the second distance L2 falls from a value greater than the second threshold value T2 to a value equal to or smaller than the second threshold value T2. Details of the operation of the stop instruction system 30 and the like will be described with reference to the flowchart shown in FIG. 3.

Figure 3:
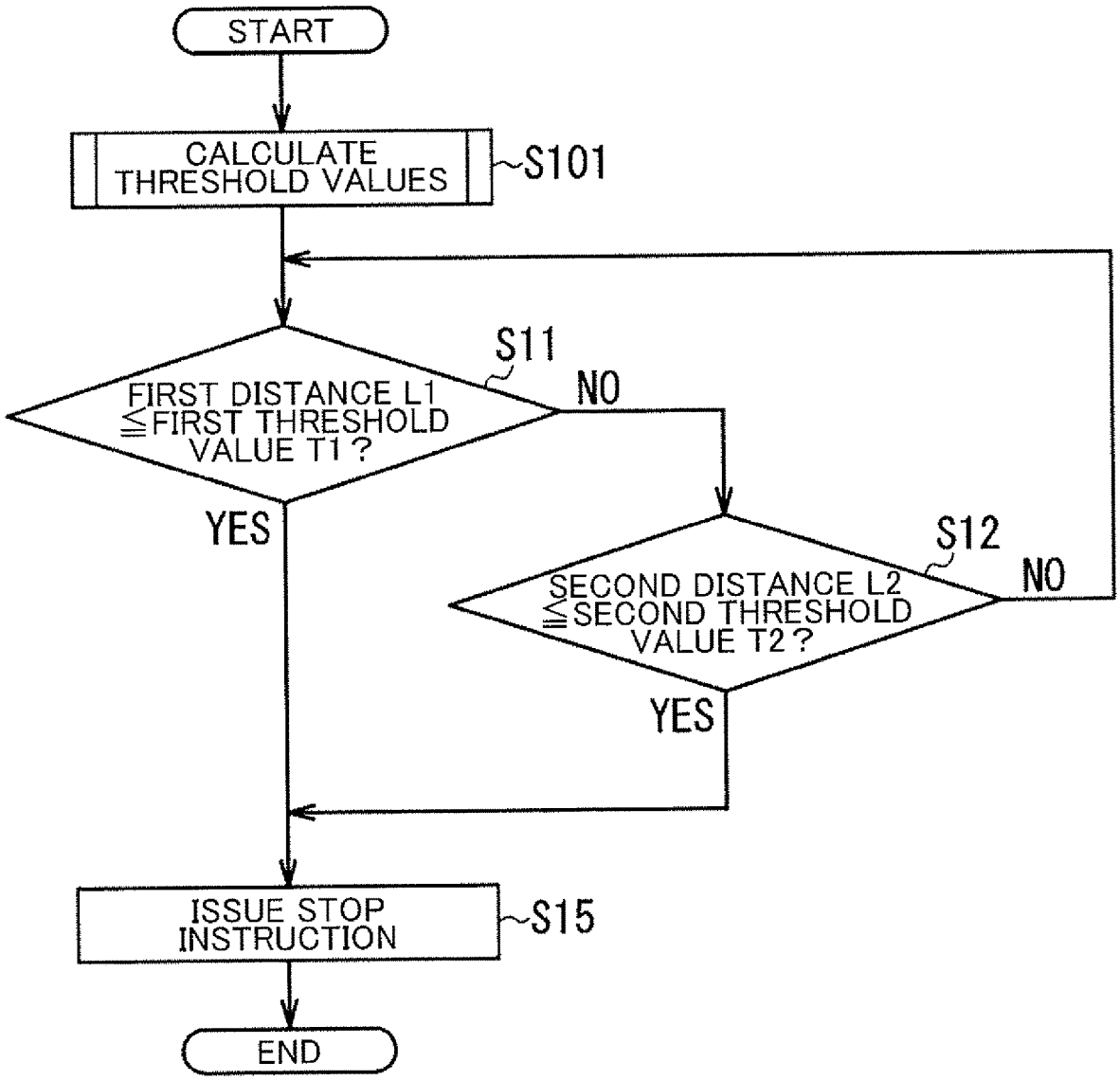
FIG. 3 is a flowchart showing processing of a controller 50 shown in FIG. 1.

In this example, at the start of the processing of the controller 50 shown in FIG. 3, the carrier 10 is sufficiently separated from the work machine 20, the first distance L1 is a value greater than the first threshold value T1, and the second distance L2 is a value greater than the second threshold value T2. In this state, the carrier 10 moves toward the work machine 20, and the first distance L1 and the second distance L2 gradually decrease. The carrier 10 moves toward the work machine 20 in such a direction that the first distance L1 becomes smaller than the second distance L2. That is, the carrier 10 moves backward toward the work machine 20 as shown in FIG. 1. For example, the carrier 10 moves toward the work machine 20 so that the direction of the carrier rear side U2 of the carrier 10 and the direction of the work machine front side X1 of the work machine 20 are opposite to each other. The work machine front rear direction X and the carrier front rear direction U may be parallel to or inclined with respect to each other.

The controller 50 calculates the first threshold value T1 and the second threshold value T2 (step S101 shown in FIG. 3). This calculation will be described later. The first threshold value T1 and the second threshold value T2 may be predetermined constant values.

The controller 50 determines whether the first distance L1 detected by the distance detection unit 41 is equal to or smaller than the first threshold value T1 (whether L1≤T1) (step S11 shown in FIG. 3). When L1≤T1 is satisfied, the processing flow proceeds to step S15 (see FIG. 3). When L1≤T1 is not satisfied (when L1>T1 is satisfied), the processing flow proceeds to step S12 (see FIG. 3).

The controller 50 determines whether the second distance L2 detected by the distance detection unit 41 is equal to or smaller than the second threshold value T2 (whether L2≤T2) (step S12 shown in FIG. 3). When L2≤T2 is satisfied, the processing flow proceeds to step S15 (see FIG. 3). When L2≤T2 is not satisfied (when L1>T1 and L2>T2 are satisfied), the processing flow returns to step S11 (see FIG. 3).

When at least either the condition of L1≤T1 or L2≤T2 is satisfied, the controller 50 causes the stop instruction output unit 47 (see FIG. 2) to output a stop instruction. Specifically, for example, the controller 50 sounds (blows) the horn, which is the stop instruction output unit 47 (see FIG. 2), for a predetermined time. The driver of the carrier 10 perceives the stop instruction (for example, hears the sound of the horn) and stops the carrier 10. Alternatively, for example, the stop instruction output unit 47 (see FIG. 2) may stop the carrier 10 by outputting a signal for automatically stopping the carrier 10. The contents of the stop instruction output from the stop instruction output unit 47 (see FIG. 2) may be common or different when L1≤T1 is satisfied and when L2≤T2 is satisfied.

(Calculation of Threshold Value T)

Figure 6:
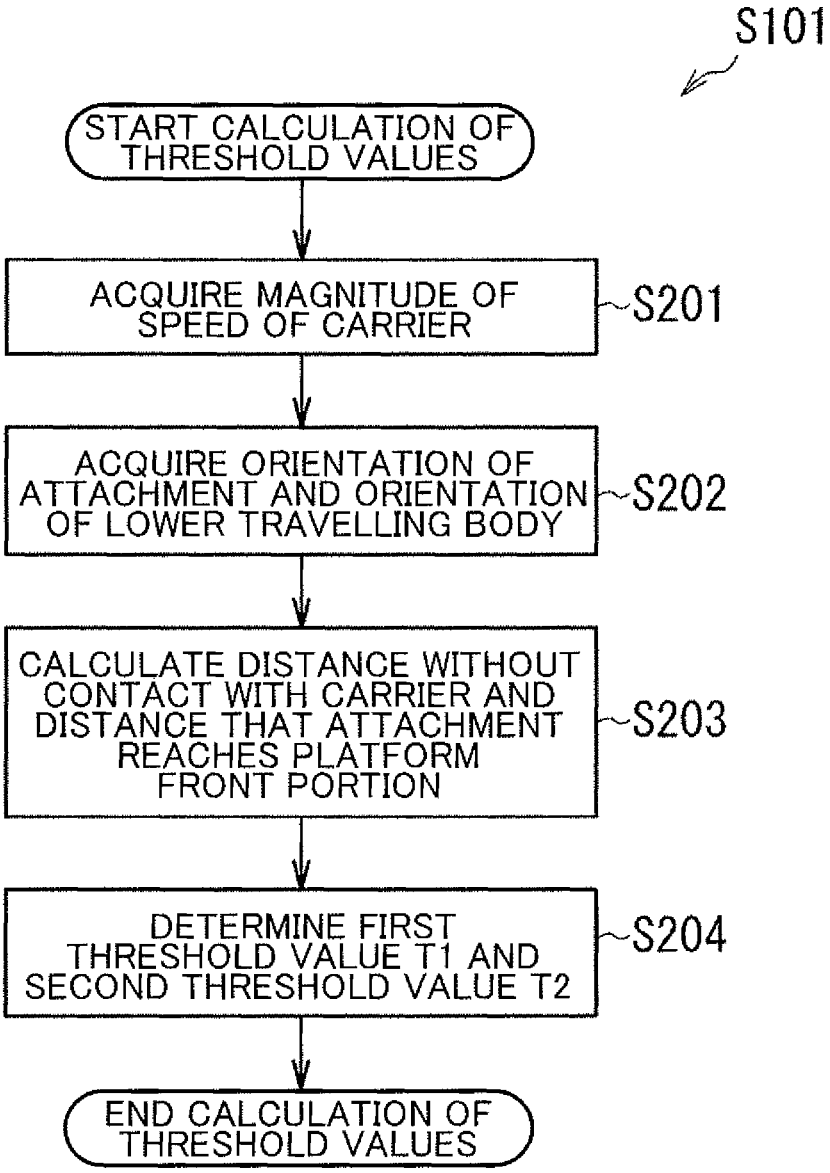
FIG. 6 is a flowchart showing processing of calculation of the threshold values (S101) shown in FIG. 3.

The controller 50 calculates (changes) the threshold value T (the first threshold value T1 and the second threshold value T2) based on various conditions (see step S101 shown in FIG. 3 and FIG. 6).

(Calculation of Threshold Value T Based on Speed of Carrier 10)

Figure 4:
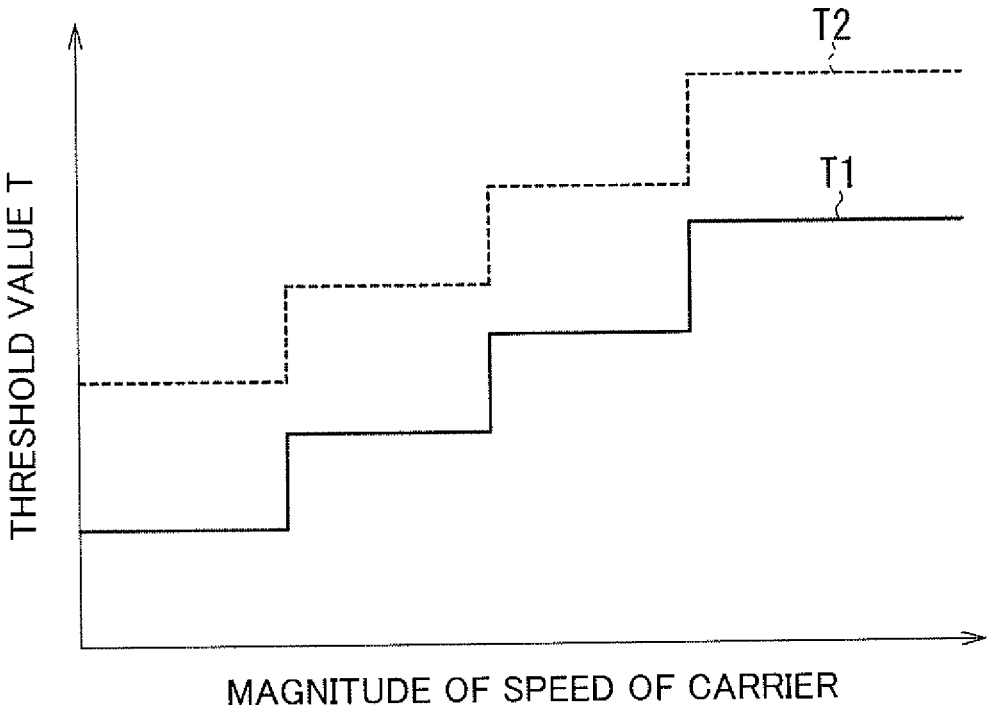
FIG. 4 is a graph showing a relationship between a magnitude of a speed of the carrier 10 shown in FIG. 1 and a first threshold value T1 and a second threshold value T2 shown in FIG. 3.

A time lag occurs between the time when the stop instruction output unit 47 (see FIG. 2) outputs the stop instruction (see step S15 shown in FIG. 3) and the time when the carrier 10 actually stops. It is assumed that the higher the speed of the carrier 10 when the stop instruction is output, the longer the time lag, and the carrier 10 does not stop at an appropriate position. Therefore, the controller 50 changes the threshold value T based on the magnitude of the speed of the carrier 10 with respect to the work machine 20. That is, the controller 50 changes the timing at which the stop instruction is output based on the magnitude of the speed of the carrier 10 with respect to the work machine 20. The speed of the carrier 10 with respect to the work machine 20 is detected by the carrier speed detection unit 42 (see FIG. 2). When the speed of the carrier 10 is higher, the controller 50 sets the threshold value T (specifically, each of the first threshold value T1 and the second threshold value T2) to be greater so that the stop instruction is output at an earlier timing (see, for example, FIG. 4). The controller 50 may change the threshold value T stepwise as shown in FIG. 4 or continuously with respect to the speed of the carrier 10.

(Calculation of First Threshold Value T1 Based on Orientation of Work Machine 20)

Depending on the orientation of the work machine 20, how close the carrier 10 can approach the work machine 20 (approach the work machine 20 without contacting the work machine) changes. Therefore, the controller 50 changes the first threshold value T1 in accordance with the orientation of the work machine 20.

(Calculation of First Threshold Value T1 Based on Orientation of Lower Travelling Body 21)

The controller 50 changes the first threshold value T1 based on information on the size and shape of the lower travelling body 21 and the orientation (for example, angle) of the lower travelling body 21 with respect to the carrier 10. The orientation of the lower travelling body 21 with respect to the carrier 10 is detected by the lower travelling body orientation detection unit 43 (see FIG. 2) (details of the detection are as described above). The information (specification information) on the size and shape of the lower travelling body 21 is set in the controller 50. The information on the size and shape of the lower travelling body 21 may be input to the controller 50 by communication, and may be stored in the controller 50, for example, at the time of production of the work machine 20. The information on the size and shape of the lower travelling body 21 may be calculated based on a two-dimensional image or a distance image. In this case, the image and the distance image may be acquired by the distance detection unit 41, the lower travelling body orientation detection unit 43 (see FIG. 2), or a sensor other than the above.

Figure 5:
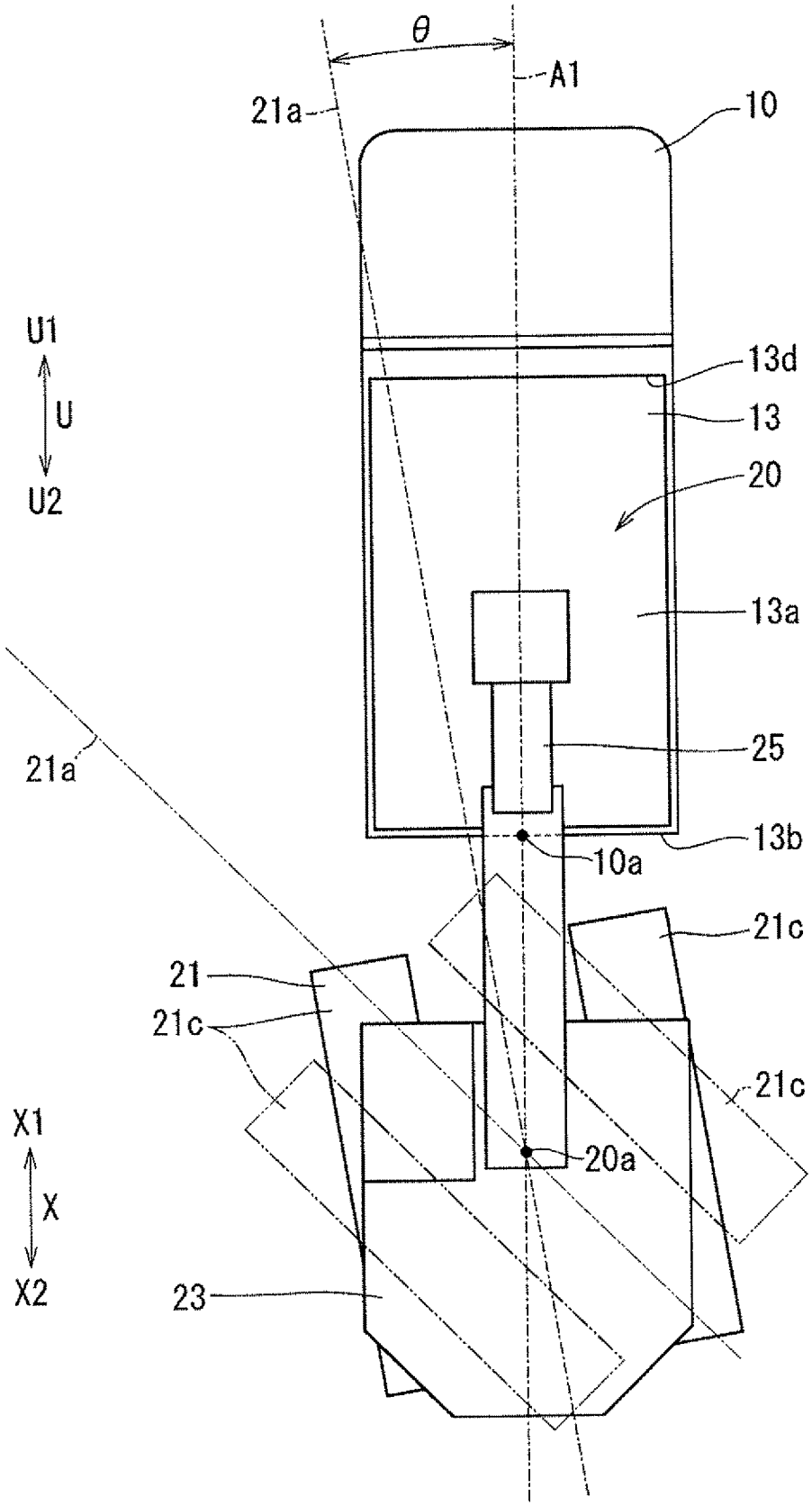
FIG. 5 is a diagram of the carrier 10 and the work machine 20 shown in FIG. 1 as viewed from above.

Specifically, for example, as shown in FIG. 5, a straight line passing through the reference position 20*a* of the work machine 20 and a specific position 10*a* (for example, a position closest to the reference position 20*a*) of the carrier 10 when viewed from above is defined as a straight line A1. A central axis of the lower travelling body 21 is defined as a lower travelling body central axis 21*a*. The lower travelling body central axis 21*a* is a straight line extending in a direction in which the crawlers 21*c* extends, and is a straight line passing through the center of the left and right crawlers 21*c* and 21*c*. At this time, depending on an angle θ formed by the straight line A1 and the lower travelling body central axis 21*a*, a distance between the lower travelling body 21 and the carrier 10 changes, and how close the carrier 10 can approach the work machine 20 (approach without contacting the work machine 20) changes. For example, the controller 50 (see FIG. 1) sets the first threshold value T1 to be smaller when the angle θ is 0° or 90° than when the angle θ is between 0° and 90° (45° or the like). For example, a length of the lower travelling body 21 in the front rear direction (a length in the direction in which the lower travelling body central axis 21*a* extends) may be longer than a length of the lower travelling body 21 in a width direction (length in direction in which the left and right crawlers 21*c* and 21*c* face each other). In this case, the controller 50 (see FIG. 1) sets the first threshold value T1 to be smaller when the angle θ is 90° than when the angle θ is 0°. Note that a method of setting the first threshold value T1 is an example, and the first threshold value T1 can be set variously (the same applies to the following example of the setting method).

(Calculation of First Threshold Value T1 Based on Orientation of Attachment 25)

The controller 50 changes the first threshold value T1 based on information on the size and shape of the attachment 25 and the orientation of the attachment 25. The orientation of the attachment 25 is detected by the attachment orientation detection unit 44 (see FIG. 2) (details of the detection are as described above). The information on the size and shape of the attachment 25 is set in the controller 50 similarly to the information on the size and shape of the lower travelling body 21. The controller 50 may further change the first threshold value T1 based on information on the carrier 10 (for example, three-dimensional shape information). The information on the carrier 10 may be calculated based on a two-dimensional image or a distance image. In this case, the image and the distance image may be acquired by the distance detection unit 41 or a sensor other than the distance detection unit 41.

Specifically, for example, the controller 50 may change the first threshold value T1 based on a height of the attachment 25 (for example, the distal end attachment 25*c*) from a ground and a height of the platform 13 of the carrier 10 from the ground. For example, when the entire distal end attachment 25*c* is located above a predetermined height H (see FIG. 1) determined from the height of the platform 13, the controller 50 sets the first threshold value T1 to be smaller than when at least a part of the distal end attachment 25*c* is located below the predetermined height H. For example, the controller 50 may compare information on the three-dimensional position and shape of the attachment 25 with information on the three-dimensional position and shape of the carrier 10, and set the first threshold value T1 so that the carrier 10 can stop with a predetermined space apart from the work machine 20.

(Specific Example of Calculation of Threshold Value T)

A specific example of processing of calculating the threshold value T by the controller 50 will be described with reference to a flowchart shown in FIG. 6. The controller 50 shown in FIG. 1 acquires the magnitude of the speed of the carrier 10 detected by the carrier speed detection unit 42 (see FIG. 2) (step S201 shown in FIG. 6). The controller 50 acquires the orientation of the attachment 25 detected by the attachment orientation detection unit 44 (see FIG. 2) and the orientation of the lower travelling body 21 detected by the lower travelling body orientation detection unit 43 (see FIG. 2) (step S202 shown in FIG. 6). The controller 50 calculates values necessary for calculating the first threshold value T1 and the second threshold value T2 from information acquired in steps S201 and S202 (see FIG. 6). Specifically, for example, the controller 50 calculates such a distance (a distance necessary for calculating the first threshold value T1) from the reference position 20*a* to the platform rear portion 13*b* that the carrier 10 can approach the work machine 20 without contacting the work machine 20. In addition, the controller 50 calculates such a distance from the reference position 20*a* to the platform front portion 13*d* (a distance necessary for calculating the second threshold value T2) that the attachment 25 reaches the platform front portion 13*d*. Then, the controller 50 determines (calculates) the first threshold value T1 and the second threshold value T2 from the above values (step S204 shown in FIG. 6).

(Effects of First Invention)

Effects of the stop instruction system 30 shown in FIG. 1 are as follows. The stop instruction system 30 issues an instruction to stop the carrier 10 approaching the work machine 20. The stop instruction system 30 includes the distance detection unit 41, the stop instruction output unit 47 (see FIG. 2), and the controller 50. The distance detection unit 41 detects a distance of the carrier 10 from the work machine 20. The stop instruction output unit 47 (see FIG. 2) outputs a stop instruction as the instruction to stop the carrier 10.

[Configuration 1-1] The distance detection unit 41 detects the first distance L1 and the second distance L2. The first distance L1 is a distance from the specific reference position 20*a* associated with the work machine 20 to a portion (the platform rear portion 13*b*) of the platform 13 of the carrier 10 on the carrier rear side U2.

[Configuration 1-2] The second distance L2 is a distance from the reference position 20*a* to a portion (the platform front portion 13*d*) of the platform 13 on the carrier front side U1. The first threshold value T1 as a threshold value related to the first distance L1 (see FIG. 3) and the second threshold value T2 as a threshold value related to the second distance L2 (see FIG. 3) are set in the controller 50.

[Configuration 1-3] The controller 50 causes the stop instruction output unit 47 (see FIG. 2) to output a stop instruction at least either when the first distance L1 falls from a value greater than the first threshold value T1 to a value equal to or smaller than the first threshold value T1 or when the second distance L2 falls from a value greater than the second threshold value T2 to a value equal to or smaller than the second threshold value T2.

In [Configuration 1-1] and [Configuration 1-3] described above, the stop instruction output unit 47 (see FIG. 2) outputs the stop instruction when the first distance L1 from the reference position 20*a* of the work machine 20 to the platform rear portion 13*b* falls from a value greater than the first threshold value T1 to a value equal to or smaller than the first threshold value T1. Therefore, in a case where the first threshold value T1 is appropriately set, the stop instruction can be issued at a timing when the distance of the platform rear portion 13*b* from the work machine 20 becomes an appropriate distance. In [Configuration 1-2] and [Configuration 1-3] described above, the stop instruction output unit 47 (see FIG. 2) outputs the stop instruction when the second distance L2 from the reference position 20*a* of the work machine 20 to the platform front portion 13*d* falls from a value greater than the second threshold value T2 to a value equal to or smaller than the second threshold value T2. Therefore, in a case where the second threshold value T2 is appropriately set, the stop instruction can be issued at a timing when the distance of the platform front portion 13*d* from the work machine 20 becomes an appropriate distance. Therefore, the stop instruction to stop the carrier 10 can be issued at a timing when at least either the distance from the work machine 20 to the platform rear portion 13*b* or the distance from the work machine 20 to the platform front portion 13*d* becomes an appropriate distance. As a result, the stop instruction to stop the carrier 10 can be issued at a timing when the position of the carrier 10 relative to the work machine 20 becomes appropriate.

(Effects of Second Invention)

[Configuration 2] The first threshold value T1 is set so that a space is provided between a portion (the platform rear portion 13*b*) of the platform 13 on the carrier rear side U2 and the work machine 20 when the first distance L1 is equal to the first threshold value T1.

In [Configuration 2] described above, the stop instruction can be issued at a timing when there is a space between the platform rear portion 13*b* and the work machine 20, that is, at a timing when the platform rear portion 13*b* and the work machine 20 do not come into contact with each other.

(Effects of Third Invention)

[Configuration 3] The second threshold value T2 is set so that a portion (the platform front portion 13*d*) of the platform 13 on the carrier front side U1 can reach the attachment 25 when the second distance L2 is equal to the second threshold value T2.

In [Configuration 3] described above, the stop instruction can be issued at a timing when the attachment 25 can reach the platform front portion 13*d*.

(Effects of Fourth Invention)

[Configuration 4] The stop instruction system 30 includes the carrier speed detection unit 42 (see FIG. 2) that detects the speed of the carrier 10 with respect to the work machine 20. The controller 50 changes the first threshold value T1 and the second threshold value T2 based on the magnitude of the speed detected by the carrier speed detection unit 42 (see FIG. 4).

The following effects can be obtained by [Configuration 4] described above. A time lag occurs between the time when the stop instruction output unit 47 (see FIG. 2) outputs the stop instruction and the time when the carrier 10 actually stops. This time lag varies depending on the magnitude of the speed of the carrier 10 when the stop instruction output unit 47 (see FIG. 2) outputs the stop instruction. Therefore, in [Configuration 4], the controller 50 changes the first threshold value T1 and the second threshold value T2 based on the magnitude of the speed detected by the carrier speed detection unit 42 (see FIG. 2) (see FIG. 4). Accordingly, the stop instruction can be issued at a more appropriate timing.

(Effects of Fifth Invention)

[Configuration 5] The stop instruction system 30 includes the lower travelling body orientation detection unit 43 (see FIG. 2) that detects an orientation of the lower travelling body 21 of the work machine 20 with respect to the carrier 10. The controller 50 changes the first threshold value T1 based on the information on the size and shape of the lower travelling body 21 and the orientation detected by the lower travelling body orientation detection unit 43 (see FIG. 2).

The following effects can be obtained by [Configuration 5] described above. Depending on the size and shape of the lower travelling body 21 and the orientation (for example, angle) of the lower travelling body 21 with respect to the carrier 10, how close the carrier 10 can approach without contacting the work machine 20 changes (see FIG. 5). Thus, how close the carrier 10 approaches the work machine 20 when the stop instruction output unit 47 (see FIG. 2) is to output the stop instruction changes. Therefore, in [Configuration 5], the controller 50 changes the first threshold value T1 based on the information on the size and shape of the lower travelling body 21 and the orientation detected by the lower travelling body orientation detection unit 43 (see FIG. 2).

Accordingly, the stop instruction can be issued at a more appropriate timing.

(Effects of Sixth Invention)

[Configuration 6] The stop instruction system 30 includes the attachment orientation detection unit 44 (see FIG. 2) that detects the orientation of the attachment 25 of the work machine 20. The controller 50 changes the first threshold value T1 based on the information on the size and shape of the attachment 25 and the orientation detected by the attachment orientation detection unit 44.

The following effects can be obtained by [Configuration 6] described above. Depending on the size and shape of the attachment 25 and the orientation of the attachment 25, how close the carrier 10 can approach without contacting the work machine 20 changes. Thus, how close the carrier 10 approaches the work machine 20 when the stop instruction output unit 47 (see FIG. 2) is to output the stop instruction changes. Therefore, in [Configuration 6], the controller 50 changes the first threshold value T1 based on the information on the size and shape of the attachment 25 and the orientation detected by the attachment orientation detection unit 44 (see FIG. 2). Accordingly, the stop instruction can be issued at a more appropriate timing.

(Modifications)

The above embodiment may be variously modified. For example, the arrangement, shape, connection, and the like of each component of the embodiment may be changed. For example, the order of the steps in the flowcharts shown in FIGS. 3 and 6 may be changed, and some of the steps need not be performed. For example, the number of components may be changed, and some of the components need not be provided. For example, a plurality of parts different from each other may be described as one part. For example, what has been described as one part may be provided separately in a plurality of different parts. For example, the controller 50 shown in FIG. 2 may be one device or a plurality of devices. For example, a threshold value, a range, and the like of the predetermined height H shown in FIG. 1 may be constant, may be changed by manual operation, or may be automatically changed in accordance with some condition.

The invention claimed is:

1. A stop instruction system that issues an instruction to stop a carrier approaching a work machine, the stop instruction system comprising:

a distance detection unit that detects a distance of the carrier from the work machine, the work machine including a lower travelling body, an upper slewing body mounted on the lower travelling body so as to be able to slew, a boom mounted on the upper slewing body so as to be raised and lowered, an arm rotatably attached to the boom, and a distal end attachment rotatably attached to the arm, the work machine configured to capture a conveyance object using the distal end attachment and load the captured conveyance object by the distal end attachment onto the carrier;

a stop instruction output unit that outputs a stop instruction as the instruction to stop the carrier; and a controller, wherein the distance detection unit detects a first distance as a distance from a specific reference position of the work machine to a rear portion of a platform of the carrier on a carrier rear side when the carrier is approaching the work machine, and a second distance as a distance from the reference position to a front portion of the platform on a carrier front side when the carrier is approaching the work machine, a first threshold value as a threshold value to be compared with the first distance from the specific reference position of the work machine to the rear portion of the platform of the carrier and a second threshold value as a threshold value to be compared with the second distance from the reference position of the work machine to the front portion of the platform of the carrier are set in the controller, the second threshold value is set so as to enable the distal end attachment of the work machine to reach the front portion of the platform of the carrier when the second distance is equal to the second threshold value, and the controller causes the stop instruction output unit to output the stop instruction at least either when the first distance from the specific reference position of the work machine to the rear portion of the platform of the carrier falls from a value greater than the first threshold value to a value equal to or smaller than the first threshold value or when the second distance from the reference position of the work machine to the front portion of the platform of the carrier falls from a value greater than the second threshold value to a value equal to or smaller than the second threshold value.

2. The stop instruction system according to claim 1, wherein the first threshold value is set so as to provide a space between the rear portion of the platform on the carrier rear side and the work machine when the first distance is equal to the first threshold value.

3. The stop instruction system according to claim 1, further comprising a carrier speed detection unit that detects a magnitude of a speed of the carrier relative to the work machine, wherein the controller changes the first threshold value and the second threshold value based on the magnitude of the speed detected by the carrier speed detection unit.

4. The stop instruction system according to claim 1, further comprising a lower travelling body orientation detection unit that detects an orientation of the lower travelling body of the work machine with respect to the carrier, wherein the controller changes the first threshold value based on information on a size and a shape of the lower travelling body and the orientation detected by the lower travelling body orientation detection unit.

5. The stop instruction system according to claim 1, further comprising an attachment orientation detection unit that detects an orientation of the attachment of the work machine, wherein the controller changes the first threshold value based on information on a size and a shape of the attachment and the orientation detected by the attachment orientation detection unit.

6. The stop instruction system according to claim 1, wherein the reference position is a specific point on a central axis of slewing of the upper slewing body of the work machine with respect to the lower travelling body of the work machine.

7. The stop instruction system according to claim 1, wherein the distance detection unit includes a light detection and ranging or laser imaging detection and ranging sensor, a time of flight sensor, or a stereo camera.

8. The stop instruction system according to claim 1, wherein the stop instruction output unit includes a horn, a speaker, a light, or a display.

9. The stop instruction system according to claim 1, wherein the controller changes the first threshold value based on a height of the attachment of the work machine from a ground and a height of the platform of the carrier from the ground.

10. The stop instruction system according to claim 1, wherein the second threshold value is greater than the first threshold value.

11. A stop instruction system that issues an instruction to stop a carrier approaching a work machine, the stop instruction system comprising:

a distance detection unit that detects a distance of the carrier from the work machine, the work machine including a lower travelling body, an upper slewing body mounted on the lower travelling body so as to be able to slew, a boom mounted on the upper slewing body so as to be raised and lowered, an arm rotatably attached to the boom, and a distal end attachment rotatably attached to the arm, the work machine configured to capture a conveyance object using the distal end attachment and load the captured conveyance object by the distal end attachment onto the carrier;

a stop instruction output unit that outputs a stop instruction as the instruction to stop the carrier; and a controller, wherein the distance detection unit detects a first distance as a distance from a specific reference position of the work machine to a rear portion of a platform of the carrier on a carrier rear side when the carrier is approaching the work machine, and a second distance as a distance from the reference position to a front portion of the platform on a carrier front side when the carrier is approaching the work machine, a first threshold value as a threshold value to be compared with the first distance from the specific reference position of the work machine to the rear portion of the platform of the carrier and a second threshold value as a threshold value to be compared with the second distance from the reference position of the work machine to the front portion of the platform of the carrier are set in the controller, the second threshold value is set so as to enable the distal end attachment of the work machine to reach the front portion of the platform of the carrier when the second distance is equal to the second threshold value, the controller causes the stop instruction output unit to output the stop instruction when the first distance is equal to or smaller than the first threshold value, and the controller causes the stop instruction output unit to output the stop instruction when the first distance from the specific reference position of the work machine to the rear portion of the platform of the carrier is greater than the first threshold value and the second distance from the reference position of the work machine to the front portion of the platform of the carrier is equal to or smaller than the second threshold value.

12. The stop instruction system according to claim 9, wherein when the entire distal end attachment is located above a predetermined height determined from the height of the platform, the controller sets the first threshold value to be smaller than when at least a part of the distal end attachment is located below the predetermined height.

13. The stop instruction system according to claim 9, wherein the controller sets the first threshold and the second threshold to be greater as a speed of the carrier increases.

* * * * *